United States Patent [19]

Miller et al.

[11] Patent Number: 4,897,049

[45] Date of Patent: Jan. 30, 1990

[54] ELECTRICAL TAP WITH PERMANENT MOUNT

[75] Inventors: Edward B. Miller, Avon, Conn.; Robert J. Mellen, North Kingstown, R.I.

[73] Assignee: General Electric Company, Schenectady, N.Y.

[21] Appl. No.: 226,504

[22] Filed: Aug. 1, 1988

[51] Int. Cl.[4] ..... H01R 13/627

[52] U.S. Cl. ..... 439/365; 439/652

[58] Field of Search ..... 439/620, 621, 622, 628, 439/652, 660, 661, 701, 365, 105, 536, 537, 359, 360, 361, 362, 363, 364; 411/388, 389, 395, 427

[56] References Cited

U.S. PATENT DOCUMENTS

| | | | |
|---|---|---|---|
| 446,871 | 2/1891 | Lieb | 439/736 |
| 2,462,756 | 2/1949 | Leopold | 439/364 X |
| 3,131,013 | 4/1964 | Carlson | 439/365 X |
| 3,775,727 | 11/1973 | Wise | 339/14 |
| 3,997,225 | 12/1976 | Horwinski | 339/14 |
| 4,180,303 | 12/1979 | Damsky | 339/166 |
| 4,500,160 | 2/1985 | Bertsch | 339/166 |
| 4,575,704 | 3/1986 | Pezold | 439/622 X |
| 4,636,125 | 1/1987 | Burgard | 411/389 |

FOREIGN PATENT DOCUMENTS

| | | | |
|---|---|---|---|
| 315182 | 7/1929 | United Kingdom . | |
| 0911424 | 11/1962 | United Kingdom | 439/105 |

*Primary Examiner*—Neil Abrams
*Assistant Examiner*—Khiem Nguyen
*Attorney, Agent, or Firm*—Edward M. Corcoran; Stanley C. Corwin; Fred Jacob

[57] ABSTRACT

A combination electric power tap and cable connector is permanently attached to a duplex wall receptacle over the wall plate by means of a mounting stud and screw, wherein the mounting stud is an elongated member having an externally threaded machine screw which screws into the receptacle at one end and an internally threaded blind hole for receiving the mounting screw at the other end.

7 Claims, 2 Drawing Sheets

ELECTRICAL TAP WITH PERMANENT MOUNT

BACKGROUND OF THE INVENTION

1. Field of the Invention

This invention relates to an electric power tap permanently attached to an electric receptacle. More particularly, this invention relates to an electrical power tap or other electrical device permanently attached to a duplex electrical wall receptacle and means for permanently attaching same.

2. Backqround of the Disclosure

Various electric taps are employed both in the home and in industry which are plugged into or attached in one way or another to a duplex electric wall receptacle. Such devices include, for example, (i) multiple outlet power taps which plug into duplex electric wall receptacles to convert the duplex receptacle to three or more line power taps and (ii) power line voltage surge protection devices which contain circuitry designed to safeguard electronic appliances from power surges caused by normal power switching found in every home, as well as overloads and, in some cases, even lightning. Such power surge protection devices also often contain a plurality of power taps for providing line voltage to the electronic appliance or appliances. Such electronic appliances include computers, VCR's, microwave ovens, high fidelity stereo equipment, various telephonic equipment, etc.

The technique most often used at the present time for mounting such electrical devices to a wall receptacle involves the use of a single mounting screw which replaces the screw that holds the wall plate to the receptacle. Some devices involve removing and tap serves as a combination wall plate and tap in one device. Such devices must fully cover or enclose the area of a standard-sized wall plate utilized with a conventional, duplex receptacle. Thus, in mounting these devices or taps to the receptacle, they must be in contact with the wall which can limit the depth of the insertion of the tap's blades into the wall receptacle. Taps utilizing this method of mounting where the wall becomes the interference can have problems with respect to a reduced amount of contact area of the blades of the plug with the contacts within the receptacle. In some cases, this can prevent a sound electrical contact between the tap and the receptacle.

On the other hand, when the wall plate is not removed and discarded, it is often dislodged from its position by the process of inserting the tap into the receptacle before the single screw is inserted through the tap to secure both the tap and wall plate to the receptacle. The consumer must then contact and reposition the potentially live wall plate. Consequently, an electrical shock hazard may result if the wall plate is metal, by shorting the blades of the tap or becoming electrically alive due to contact with one of the blade members in the dislodged position. This can also result in breakage of a glass or ceramic wall plate.

Another method of permanent mounting currently in use involves a mounting tab which rests on the surface of the wall plate. In this case, a single screw is used to attach a plug adapter, such as those employed to convert a three-wire receptacle to a two-wire receptacle. A single screw attaches both the plug and the wall plate together to the receptacle. This is a compression fit which serves to retain both the plug and the wall plate securely to both the wall and the receptacle and is not practical with large taps.

Accordingly, there is still a need for a safer and more certain method for mounting taps to duplex wall receptacles so that the tap rests on the surface of the receptacle and is not stopped or interfered with by the wall or the structure of the building. In this way, blade penetration or depth in the receptacle is deterministic and will always yield a safe, reliable electrical connection.

SUMMARY OF THE INVENTION

The present invention relates to an electric power tap permanently mounted to a duplex, electric wall receptacle and means for mounting same, wherein the tap rests on the surface of the receptacle wall plate without interference from the wall or structure of the building. This permits a predetermined penetration of the blades of the tap into the receptacle to insure an adequate, reliable and safe electrical connection. The means employed for permanently mounting the power tap to the wall receptacle comprises a combination of a mounting stud and a screw. The mounting stud is an elongated member having an externally threaded machine screw at one end and an internally threaded blind hole at the other end. In use, the externally threaded machine screw portion is screwed into the receptacle through the screw hole in the wall plate. The tap, having a mounting hole for receiving both the internally threaded portion of the stud and the mounting screw, is pressed into the receptacle and over the stud. The mounting screw, a simple machine screw, is then screwed into the stud through the mounting hole in the tap, thereby preventing the tap from being removed or dislodged from the receptacle. The mounting screw must be removed in order to remove the tap from the receptacle. If desired, the wall plate may be removed from the receptacle prior to mounting the tap, but it is preferred, for safety reasons, that the wall plate not be removed prior to screwing the mounting stud into the receptacle.

In one embodiment, the present invention relates to a multiple outlet power tap which may or may not contain a circuit breaker or a fuse for overload protection. In another embodiment the tap will comprise a multiple outlet power tap containing a plurality of line voltage receptacles, along with one or more circuit protection features such as line voltage surge protection alone, or in combination with protection circuitry for protecting electronic devices from surges that may appear across unbalanced, low voltage signal lines such as a coaxial cable or balanced lines such as the 300 ohm, flat, twin lead antenna wire employed with TV sets, etc. In yet another embodiment, one or more of the foregoing features will be combined with a tamper resistant receptacle feature in the receptacle portion or portions of the tap in order to prevent the insertion of foreign objects into the blade contact members.

DETAILED DESCRIPTION

Figure 1A:
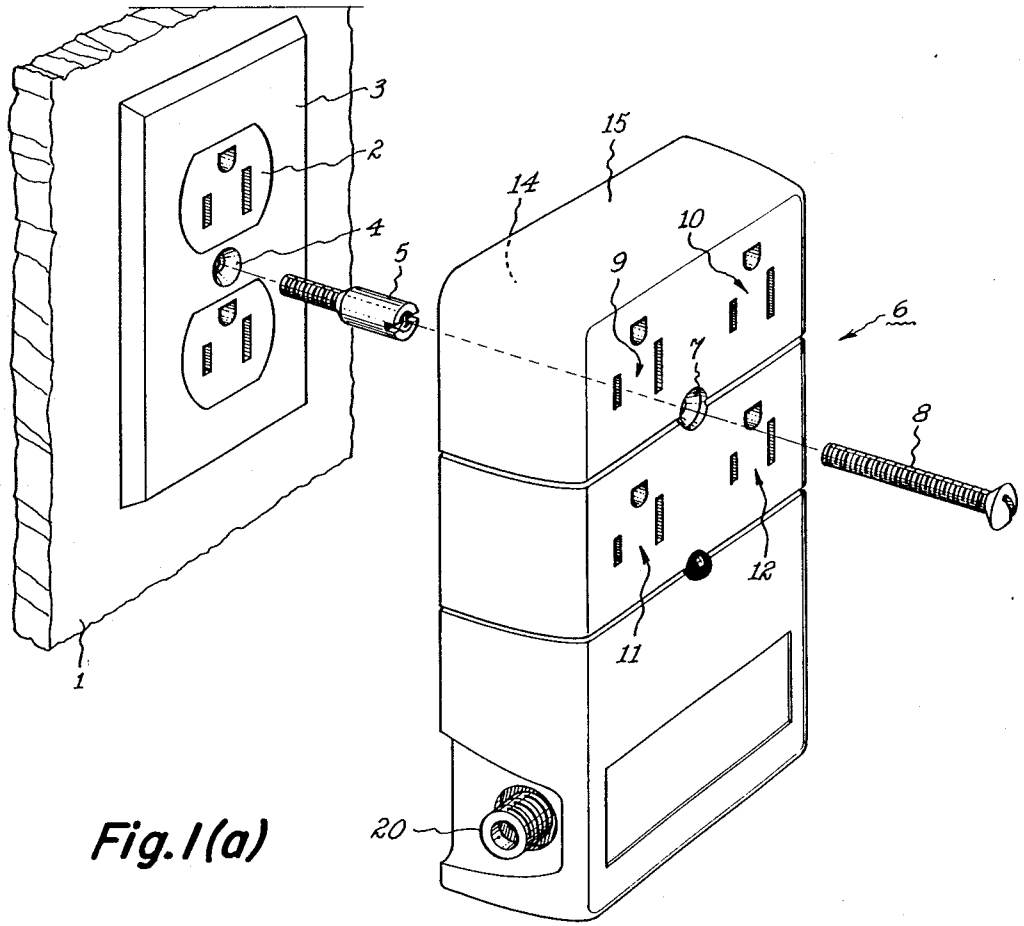
FIGS. 1(a) and 1(b) is an exploded perspective of an embodiment of this invention.
Figure 1B:
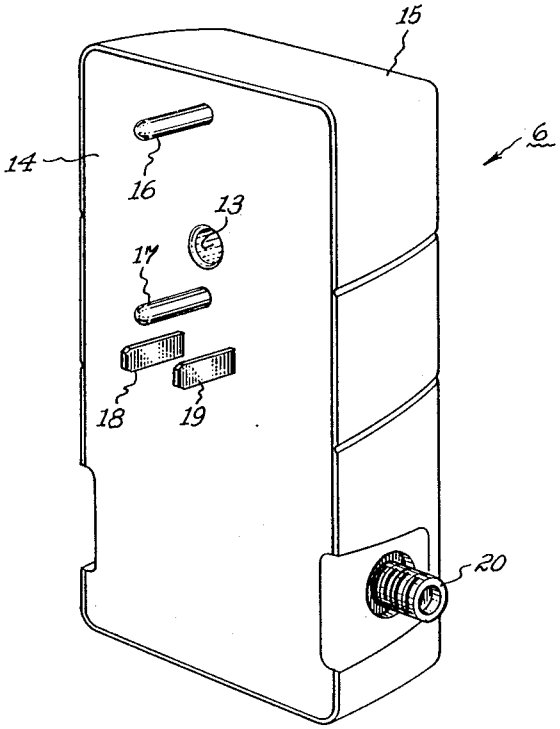

FIG. 1 depicts a wall 1 containing therein a duplex receptacle 2 of which is shown only that portion which projects through respective openings in wall plate 3. Wall plate 3 contains hole 4 from which the wall plate mounting screw has been removed. Mounting stud 5, having an externally threaded machine screw at one end and an internally threaded (machine screw threads) blind hole portion at the other end, is shown in the position in which it is to be inserted through hole 4 of wall plate 3. Tap 6 is shown as containing a chamfered cavity 7 in cover portion 15. The cavity extends to and through the back portion 14 of the tap and through which mounting screw 8 secures the tap to mounting stud 5. Tap 6 contains a hollow cover portion 15 and a back plate or rear portion 14. Back plate 14 contains a cavity 13 for receiving that portion of mounting stud 5 which projects beyond wall plate 4 and which contains the internally threaded blind hole for receiving mounting screw 8. Tap 6 also contains four line power taps 9, 10, 11 and 12, each of which contains a pair of female electrical blade contacts and a female ground contact (not shown) for receiving corresponding male blades from a male plug (not shown).

In one embodiment, the taps 9, 10, 11 and 12 will also contain a tamper resistant feature under the slotted openings for preventing insertion of foreign objects such as a pin, knife, nail, etc., into the female electrical contacts inside the tap. Such a feature can be in the form of a spring loaded shutter mechanism.

Back portion 14 is shown as containing two male ground pins 16 and 17 and a pair of male electrical blades 18 and 19 which are inserted in mating engagement into corresponding female contacts in receptacle 2 for making electrical contact and providing line voltage to the receptacles 9, 10, 11 and 12 in the tap.

In one embodiment of the invention, tap 6 will also contain a pair of cable connectors for connecting to a coaxial cable, of which only one, 20, is shown merely for purposes of illustration. In this embodiment, tap 6 will contain surge protection circuitry for protecting an appliance, such as a TV or a VCR, from voltage surges that may appear on a coaxial signal cable. In use, the coaxial signal cable will be connected to one of the two cable connectors and a TV, VCR or computer cable will be connected to the other connector. The use of such a device permits a consumer to simply and safely permanently mount a single unit to a wall receptacle which provides power to, and cable surge protection for, various appliances such as a TV, VCR or home computer. Still further, the device may also contain line voltage protection means for protecting the appliance against line voltage surges.

Figure 2:
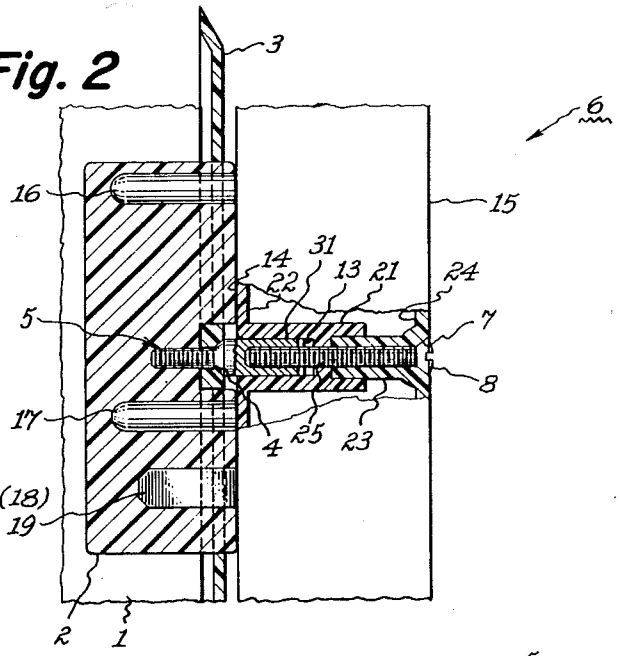
FIG. 2 is a schematic side view of an embodiment of this invention showing a power tap mounted to a wall receptacle over the wall plate by means of a mounting stud and screw.

FIG. 2 schematically illustrates the present invention in cross-section in which a power tap 6 is permanently mounted to a duplex wall receptacle 2. Thus, wall 1 contains duplex receptacle 2 mounted in a receptacle box (not shown). Receptacle 2 is shown in greatly simplified form for the sake of brevity. Tap 6 is mounted onto receptacle 2 over wall plate 3. Ground pins 16 and 17, along with blades 18 and 19 of tap 6, are shown schematically inserted into receptacle 2. Mounting stud 5 is shown with the externally threaded portion screwed into receptacle 2 through wall plate screw hole 4. Tap 6 consists of two separate portions, a cover portion 15 and a back portion 14. As shown in FIG. 1, back portion 14 contains a cavity or recessed portion 13 for receiving, or which fits over, the internally threaded portion 31 of mounting stud 5. Mounting screw 8 secures both wall plate 3 and the tap 6 onto mounting stud 5 and against duplex wall receptacle 2.

A first hollow post or cylinder 21 extends inwardly and perpendicularly from the inner surface 22 of back plate 14. Cavity 13 is defined by the interior surface of post 21. A second hollow post or cylinder 23 extends inwardly and perpendicularly from the inside surface 24 of cover 15 to fit in mating engagement into post 21. Chamfered mounting screw hole 7 is defined by the inner surface of post 23. The interior of post 21 contains a portion 25 of reduced diameter against which the interior end of post 23 abuts in mating engagement. This feature prevents distortion of cover 15 as mounting screw 8 is screwed into mounting stud 5. Such crushing and distortion of cover 15 could cause alignment and other problems with the electrical contacts and circuitry in the tap as well as bind any tamper resistant feature, thereby preventing insertion of a male plug into the receptacle portion of the tap.

Those skilled in the art will recognize that there are other ways in which either of the two posts may fit in mating engagement into the other and abut to provide such a crush resistant property and, at the same time, receive both the mounting stud 5 and mounting screw 8. Thus, post 21 could fit in mating engagement into post 23.

Figure 3:
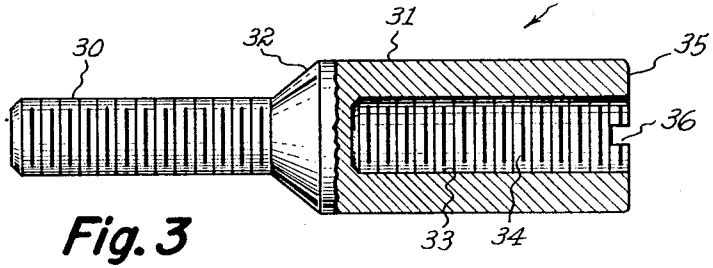
FIG. 3 schematically illustrates a preferred mounting stud of the present invention.

FIG. 3 schematically illustrates mounting stud 5. Thus, mounting stud 5 comprises at one end a machine-threaded portion 30 which terminates at one end, via chamfer 32, into cylindrical section 31 which, in a preferred embodiment is of a larger diameter than screw portion 30. Cylindrical section 31 comprises a blind hole 33 containing internal machine screw threads 34 for receiving mounting screw 8. End 35 of cylindrical portion 31 contains slotts 36 diametrically opposed to each other on the circumference thereof for receiving the blade of a screwdriver for screwing stud 5 into and/or removing same from the screw hole of the wall receptacle. The following illustrates the simple steps required in employing the present invention to permanently mount the tap to a duplex wall receptacle:

1. Remove the wall plate screw while holding the wall plate in place.
2. Screw the mounting stud into the receptacle through the wall plate screw hole to secure the wall plate permanently in place.
3. Plug the tap into the duplex wall receptacle over the mounting stud as one would plug a conventional plug into such a receptacle. The mounting stud fits into the hole in the back plate or surface of the tap.
4. Screw the mounting screw through the hole in the cover of the tap (into the internally threaded end of the mounting stud) to permanently and safely secure the tap to the wall receptacle.

What is claimed is:

1. In combination, (i) a duplex wall receptacle mounted in a wall and a wall plate mounted over said wall and receptacle, (ii) an elongated mounting stud, one end of which comprises a machine screw thread portion which is screwed into and secured in corresponding threads in said receptacle and which secures said wall plate to said receptacle and the other end of which extends outward of said receptacle and comprises a blind hole having machine threads on the interior surface thereof, (iii) a plug-in power tap containing means for receiving at least one male plug wherein said tap is plugged into said receptacle over said wall plate and has cavity means to receive said blind hole portion of said mounting stud, said tap having a front and back portion wherein said back portion contains said cavity means for accepting said mounting stud along with at least one projecting male ground pin and blades for making electrical contact with electrical blade receiving members within said wall receptacle, and said front portion of said tap containing a mounting hole or cavity axially aligned with said mounting hole in said back portion and wherein a first hollow post or cylinder extends inwardly and perpendicularly from the inner surface of either of said back or front portion and which post contains a portion of reduced diameter on the inner surface thereof and where a second hollow post or cylinder extends inwardly and perpendicularly from the inner surface of said respective front or back portion and which fits in mating engagement into said first post and wherein the end of said second post butts against said interior portion of reduced diameter in said first post and wherein said hollow portion of each of said posts are axially aligned and provide said cavity means for receiving a mounting screw with a portion of said post extending from said back portion containing said cavity means for receiving said portion of said mounting stud, and (iv) said mounting screw which is screwed into said mounting stud through said cavity means in said tap to secure said tap to said receptacle.

2. The combination of claim 1 wherein said wall plate is situated between said wall and the back portion of said tap and which does not provide interference between said wall and tap.

3. The combination of claim 1 wherein the external portion of said mounting screw is of a color which matches or harmonizes with the color of said tap.

4. The combination of claim 1 wherein the end of the internally threaded portion of said mounting stud butts against said portion of reduced diameter of said first post.

5. In combination, (i) a duplex wall receptacle mounted in a wall, (ii) an elongated mounting stud, one end of which comprises a machine screw thread portion which is screwed into and secured in corresponding threads in said receptacle and the other end of which extends outward of said receptacle and comprises a blind hole having machine threads on the interior surface thereof, (iii) a plug-in power tap containing means for receiving at least one male plug wherein said tap is plugged into said receptacle and has cavity means to receive said blind hole portion of said mounting stud, said tap having a front and back portion wherein said back portion contains said cavity means for accepting said mounting stud along with at least one projecting male ground pin and blades for making electrical contact with electrical blade receiving members within said wall receptacle, and said front portion of said tap containing a mounting hole or cavity axially aligned with said mounting hole in said back portion and wherein a first hollow post or cylinder extends inwardly and perpendicularly from the inner surface of said back or front portion and which post contains a portion of reduced diameter on the inner surface thereof and where a second hollow post or cylinder extends inwardly and perpendicularly from the inner surface of either of said back or front portion and which post contains a portion of reduced diameter on the inner surface thereof and where a second hollow post or cylinder extends inwardly and perpendicularly from the inner surface of said respective front or back portion and which fits in mating engagement into said first post and wherein the end of said second post butts against the interior portion of reduced diameter in said first post and wherein said hollow portion of each of said posts are axially aligned and provide said cavity means for receiving a mounting screw with a portion of said post extending from said back portion containing said cavity means for receiving said portion of said mounting stud, and (iv) said mounting screw which is screwed into said mounting stud through said cavity means in said tap to secure said tap to said receptacle.

6. A power tap containing means for receiving at least one male plug wherein said tap is plugged into a receptacle, said tap having a front and back portion wherein said back portion contains at least one projecting male ground pin and blades for making electrical contact with electrical blade receiving members within said receptacle, and said front portion of said tap containing a mounting hole or cavity axially aligned with a mounting hole in said back portion and wherein a first hollow post or cylinder extends inwardly and perpendicularly from the inner surface of either of said back or front portion and which post contains a portion of reduced diameter on the inner surface thereof and where a second hollow post or cylinder extends inwardly and perpendicularly from the inner surface of said respective front or back portion and which fits in mating engagement into said first post and wherein the end of said second post butts against said interior portion of reduced diameter in said first post and wherein said hollow portion of each of said posts are axially aligned and provide said cavity means for receiving a mounting screw.

7. The tap of claim 6 wherein said back portion has cavity means for receiving a mounting stud and wherein a portion of said post extending from said back portion also contains cavity means for receiving said portion of said mounting stud.

* * * * *